US005896909A

United States Patent [19]

Sartini

[11] Patent Number: 5,896,909

[45] Date of Patent: Apr. 27, 1999

[54] SWAG HOLDER

[75] Inventor: Eugene R. Sartini, Fall River, Mass.

[73] Assignee: Kenney Manufacturing Company, Warwick, R.I.

[21] Appl. No.: 08/990,916

[22] Filed: Dec. 15, 1997

[51] Int. Cl.[6] ..... E06B 9/38

[52] U.S. Cl. ..... 160/349.1; 160/348; 160/38

[58] Field of Search ..... 160/349.1, 349.2, 160/348, 38, 39, 19, 178.1 R, 178.1 V

[56] References Cited

U.S. PATENT DOCUMENTS

| | | | |
|---|---|---|---|
| 2,618,328 | 11/1952 | Latham | 160/330 X |
| 4,384,605 | 5/1983 | Schaeffer et al. | 160/38 |
| 4,828,002 | 5/1989 | Ashby | 160/38 |
| 4,840,216 | 6/1989 | John | 160/38 X |
| 4,957,255 | 9/1990 | John | 160/38 X |
| 5,144,997 | 9/1992 | Marasco et al. | 160/349.2 |
| 5,188,162 | 2/1993 | Simon et al. | 160/38 X |
| 5,219,013 | 6/1993 | Rozon | 160/38 X |
| 5,417,271 | 5/1995 | Fenley | 160/38 |
| 5,520,234 | 5/1996 | Simmons | 160/38 |

*Primary Examiner*—David M. Purol
*Attorney, Agent, or Firm*—Robert J Doherty

[57] ABSTRACT

A swag holder adapted for direct attachment to the head rail of a window blind system including an upper arm in turn providing a supporting surface for the swag at a position forwardly adjacent to the head rail and a lower arm having an attachment clip through which the holder is directly mounted to the head rail and wherein the clip is preferably rotatable between alternate positions to accommodate varied head rail configurations.

16 Claims, 7 Drawing Sheets

SWAG HOLDER

BACKGROUND AND OBJECTS OF THE INVENTION

This invention relates to decorative window treatments and more particularly to a holder for the placement and support of a fabric swag used in providing such decorative window treatment. Such swags are commonly utilized to hide or soften the wood casement molding or paneling surrounding a window as well as to to some extent the mounting hardware associated with window blinds adjacent thereto. Such swags normally are of a decorative fabric material although other materials such as paper and plastic can be utilized and are generally utilized to convey stylized effects of color, depth and pattern to coordinate with other home or office furnishings in the room as well as to, as previously indicated, hide or mask plain or uncoordinated window wood surrounds.

Generally, these swags are supported by an arm or hook or some other type of support which is fastened directly to the wall or woodwork surrounding the window and thus represents a somewhat fixed or at least semi-permanent installation, and one that is often beyond the skill or inclination of the homeowners as well as those individuals such as designers, interior decorators and the like suggesting such treatment. It, accordingly, would be desirable to be able to easily mount the holders for such swags and to provide a holder designed not only for easy and detachable mounting in mind but one that accomplishes the swag holding task in a straightforward, decorative and functional manner.

A further object of the present invention is to provide such a swag holder which can easily be positioned at various intervals along the upper end of the window and proximate to the casement desired to be covered or appearance altered and once so installed can be easily adjusted to various angular relationships with such casement and the window surrounded thereby such that the final window treatment can be experimented with and varied as desired by the homeowner and/or the design consultant. It is a further object of the present invention to provide a swag holder with the above-mentioned advantages yet one that is reasonably easy to utilize and of low cost, simple construction.

These and other objects of the invention are accomplished by the provision of a swag holder which includes a support and a retaining clip portion attached thereto such that the composite structure may be fixedly but adjustably attached directly to the head rail of a window blind anywhere along the length thereof.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
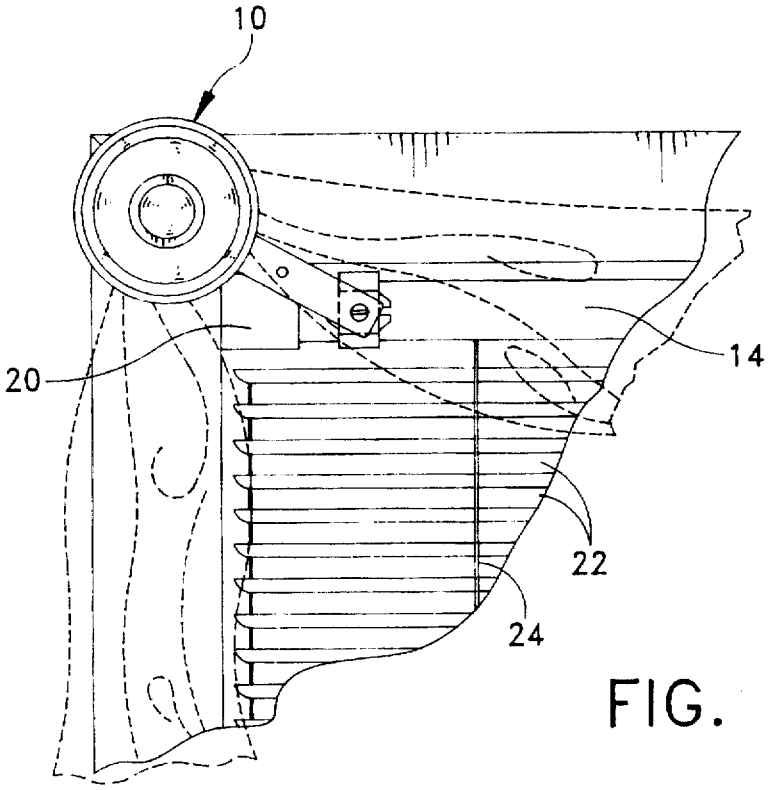
FIG. 1 is a partial front elevational view showing the upper corner section of a window provided with horizontally oriented window blinds showing the manner in which the swag holder of the present invention may be mounted to achieve the objects of the invention.
Figure 2:
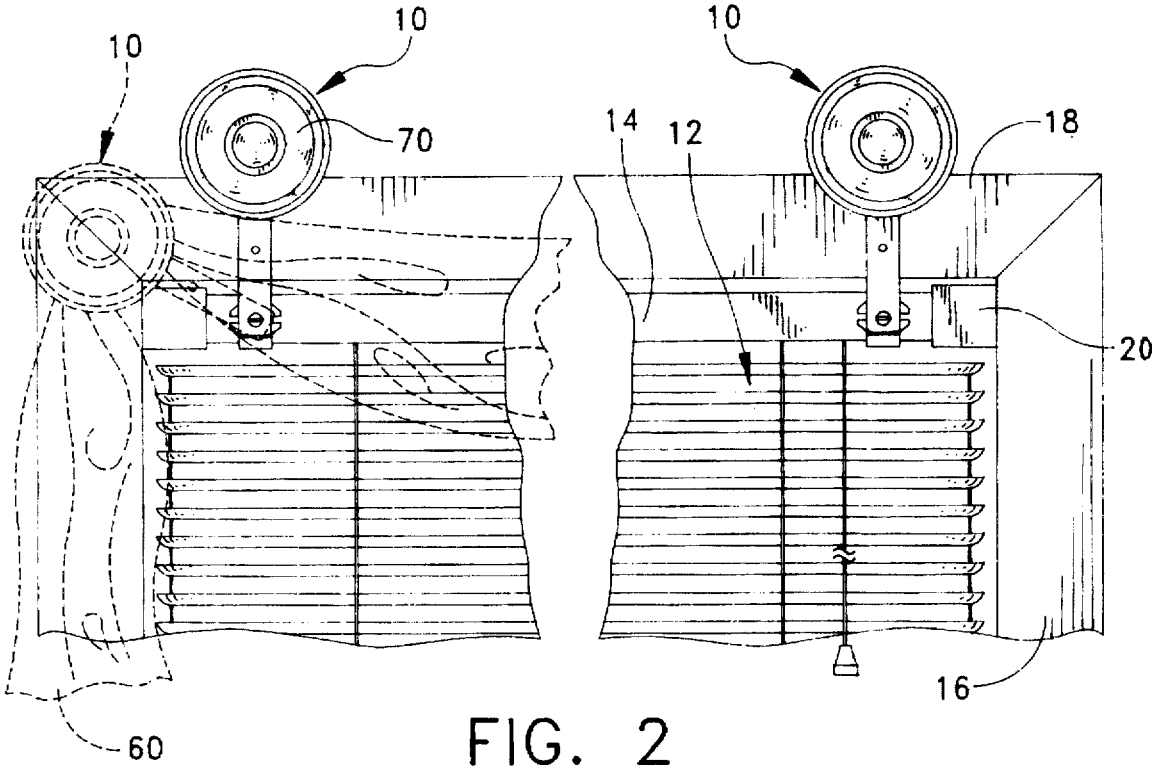
FIG. 2 is a view similar to FIG. 1 but showing alternate positioning of the swag holder of the present invention as well as the use of two or more of such swag holders simultaneously.

Turning now to the drawings and particularly to FIGS. 1 and 2 thereof, the general household environment in which the device of the present invention is utilized is depicted along with possible mounting positions thereof. The device 10 of the present invention is, as illustrated, primarily designed for attachment to the upper mounting rail 14 of window blinds 12 mounted within the window aperture defined by vertical and horizontal window casement moldings 16, 18 respectively. Such window blinds 12 may be of the type normally described by the nomenclature mini blinds and include, as above mentioned, an upper rail 14 usually adapted to be received within brackets 20 mounted adjacent the window aperture. Such brackets 20 are of known construction and usually take the form of box-like structures adapted to receive the head rail and secure such in place. In addition to the upper or head rail 14, the window blinds 12 generally include a lower rail (not shown), a plurality of slats 22 and a pair of combination lift and tilt cords 24.

Figure 7A:
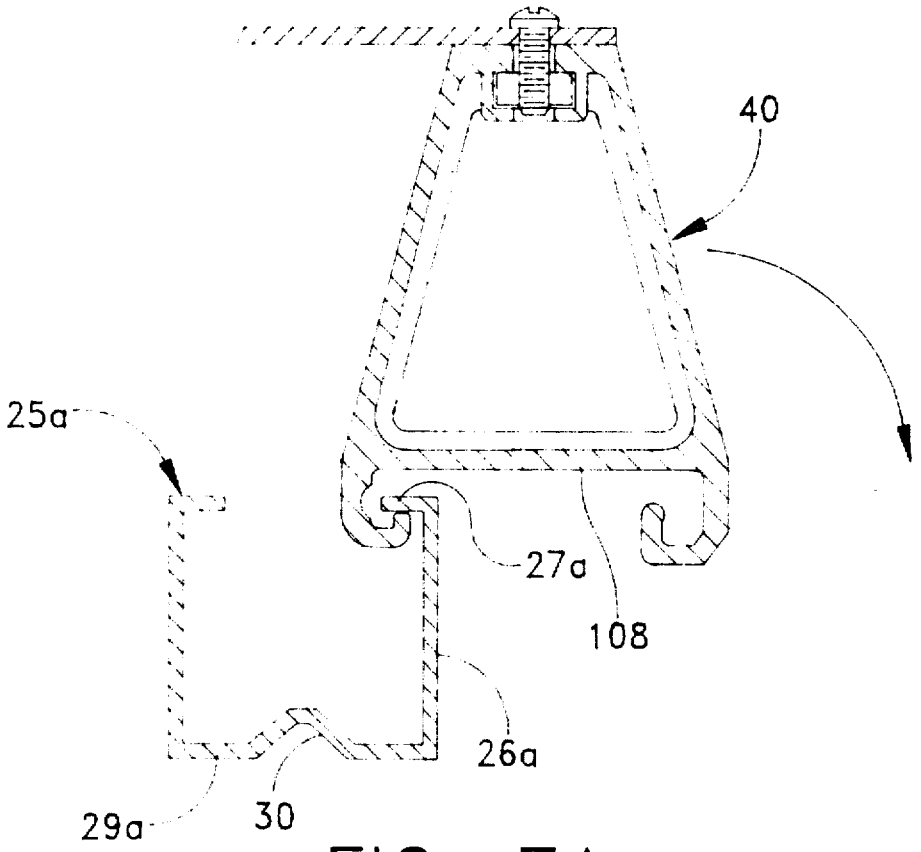
FIG. 7A is a partial side sectional view showing a preliminary stage of mounting the device with the regaining clip portion thereof oriented in the first position as shown in FIG. 6A to the head rail of a window blind.
Figure 8A:
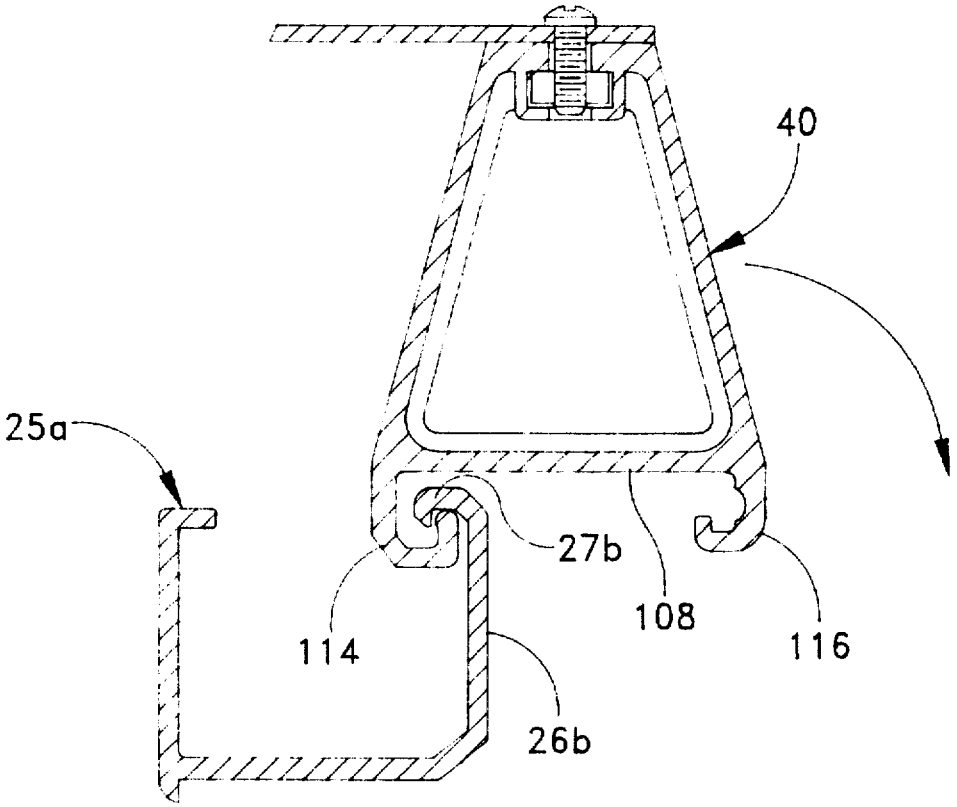
FIG. 8A is a partial side sectional view showing a preliminary stage of mounting the device with the retaining clip portion thereof oriented in the second alternate position as shown in FIG. 6B and to a modified form of a head rail of a window blind.

The cross-sectional configuration of the upper or head rail 14 may take various forms, but generally such takes the form of a U-shaped box-like body having an open upper end and a relatively stiff forwardly facing face plate which terminates at its upper edge in an inwardly extending lip which may include a downwardly extending terminal finger. Two such alternate head rail configurations are shown in FIGS. 7A and 8A—that shown in FIG. 7A being a relatively generic type head rail for lower cost window blinds while that shown in FIG. 8A represents a higher end window blind application of stronger, heavier and more stylish construction. The FIG. 8A head rail construction is that utilized by Kenney Mfg. Co. under their Genesis trademark.

Figure 7B:
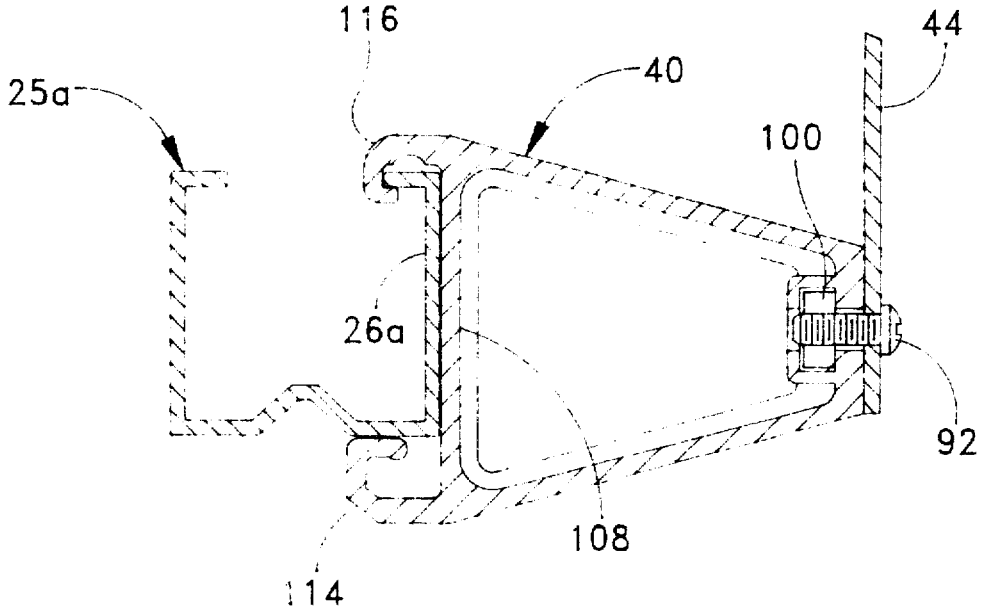
FIG. 7B is a view similar to FIG. 7A but showing the completed mounting position.
Figure 8B:
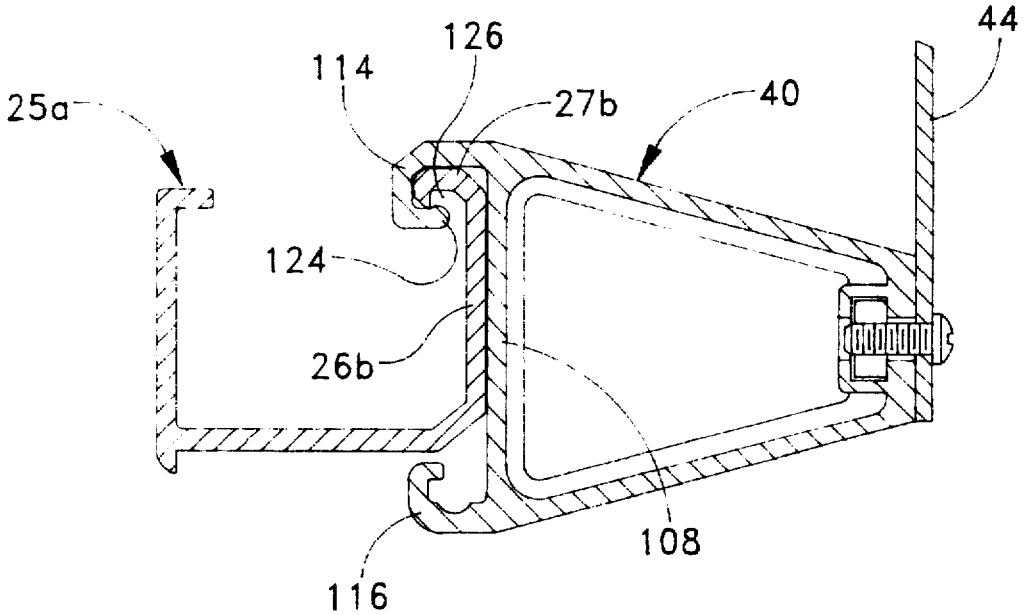
FIG. 8B is a view similar to FIG. 8A but showing the completed mounting position.
Figure 9:
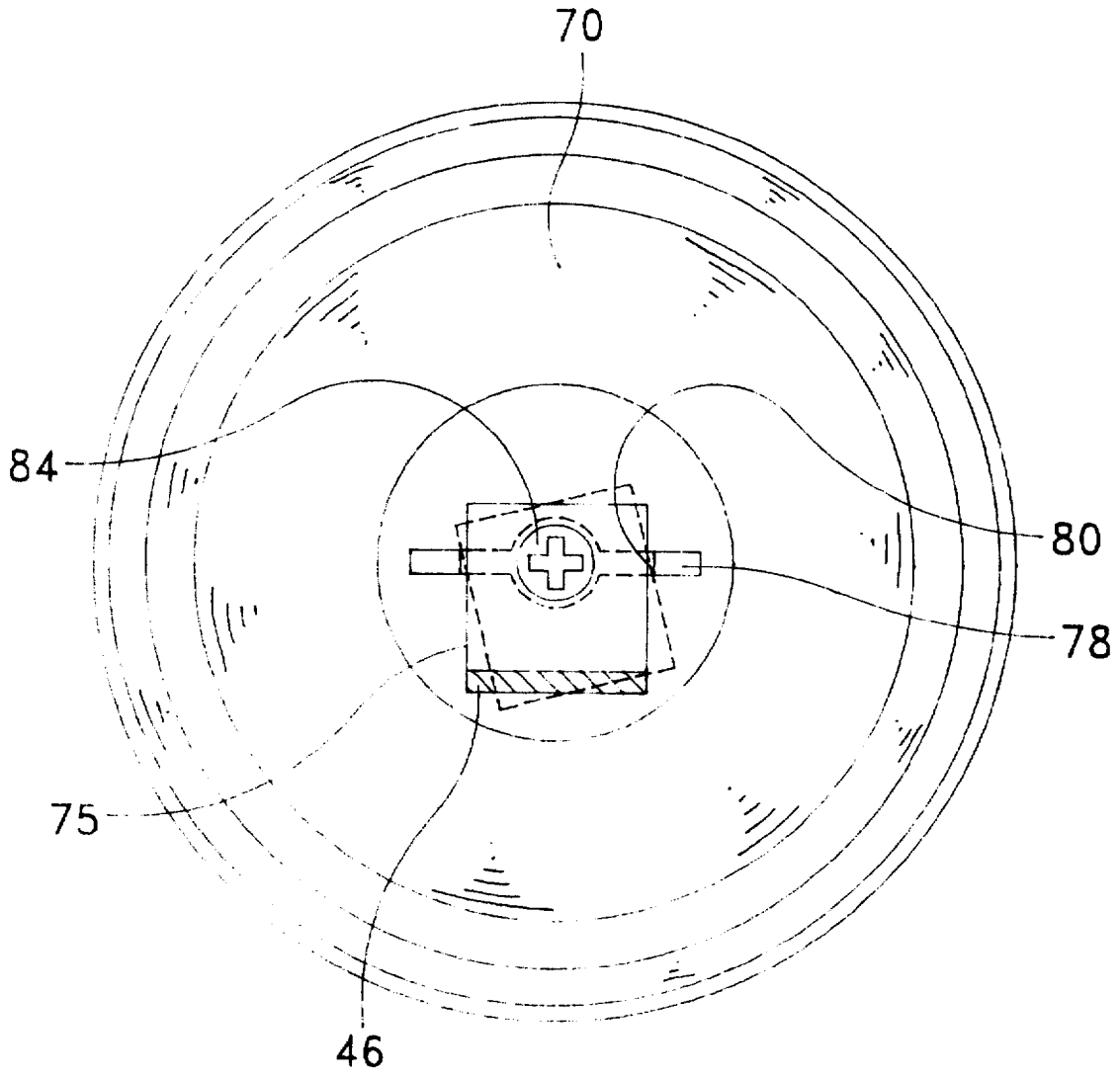
FIG. 9 is an elevational view taken along the line 9—9 of FIG. 4.

The standard or generic head rail construction shown in FIGS. 7A and 7B as above indicated includes a generally U-shaped box-like body **25*a* having an open upper end and a relatively stiff forwardly facing face plate 26a which in turn terminates in an inwardly extending lip 27a. The base 29a of the body may include a stiffening groove 30. Generally, the head rail is formed of painted cold rolled steel or other suitable materials that can include extruded plastics. The head rail shown in FIGS. 8A and 8B is of thicker walled, stronger construction but also includes a body 25b, face plate 26b and lip 27b, which lip includes a downwardly extending terminal finger 31. The overall appearance of a higher quality and more stylish look is a distinguishing feature of the 8A head rail from that shown in FIG. 7A**.

With either rail configuration, the desired end result is to provide the present device 10 with a retaining clip portion 40 so configured to enable it to directly engage the head rail and thus enables the device 10 to be directly mounted in the desired position to the upper rail 14 of the window blinds 12. Such mounting may be at the corners adjacent the moldings 16 and 18 and/or may be longitudinally removed therefrom at various positions along the longitudinal extent of the upper rail 14 to achieve various design effects. One of the design effects to be achieved by the present invention is to enable the wood casement molding surrounding the window or at least the upper portions thereof and particularly the corners to be concealed by the placement of a fabric swag, that is, a running length of fabric or other material either pleated, bunched or presented in various fashion modes, and held in place by the device 10 of the present invention as will be hereinafter more fully brought out especially in referring to FIGS. 7A, 7B, 8A and 8B in particular. It should be realized that in this way then, the functional or contemporary look achieved by wood window moldings even those which are well designed and decorative in and of themselves can be modified to achieve various design effects by the placement of such swags in the intended manner.

Figure 3:
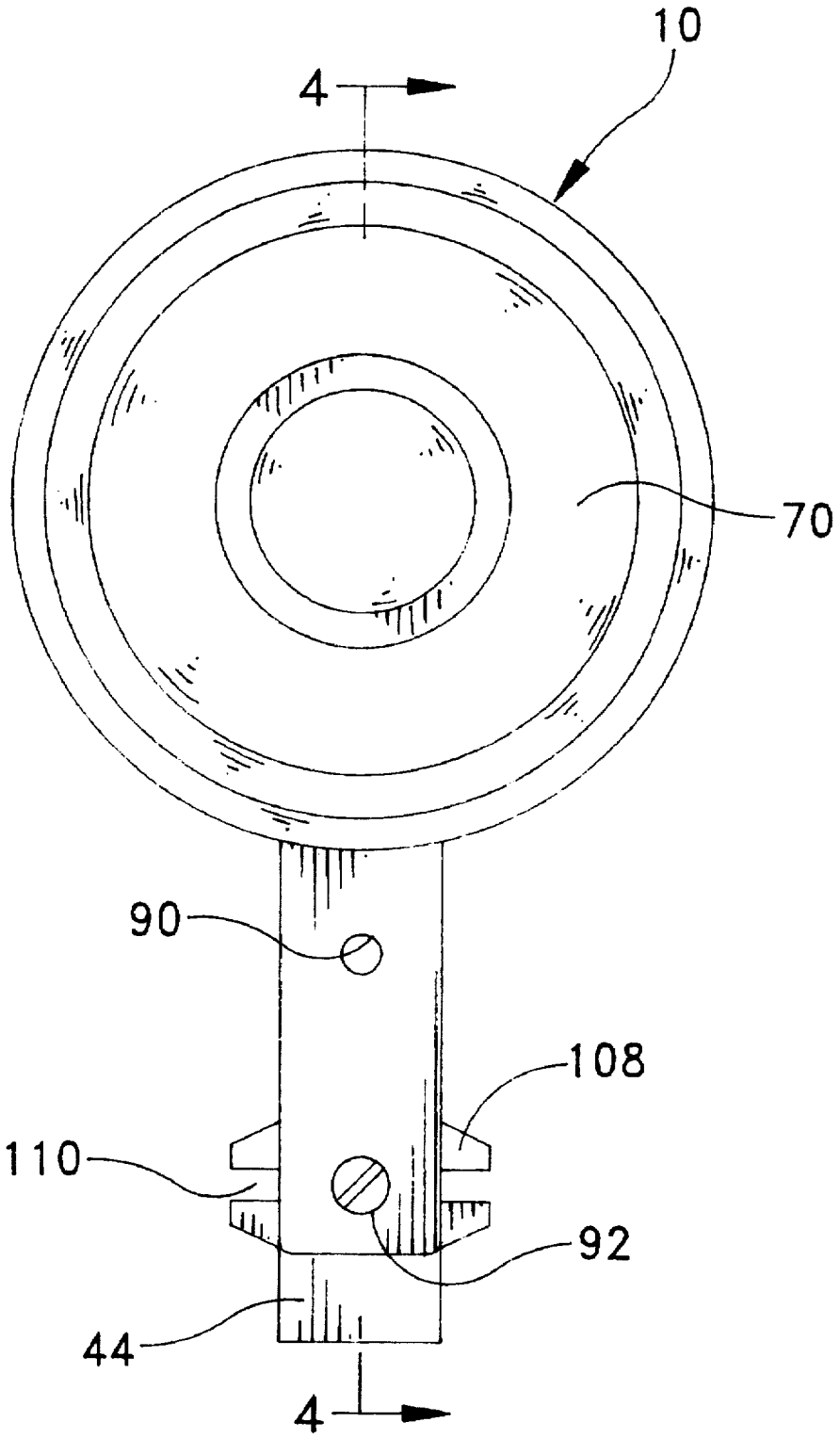
FIG. 3 is a front elevational view of the swag holder on an enlarged scale.
Figure 4:
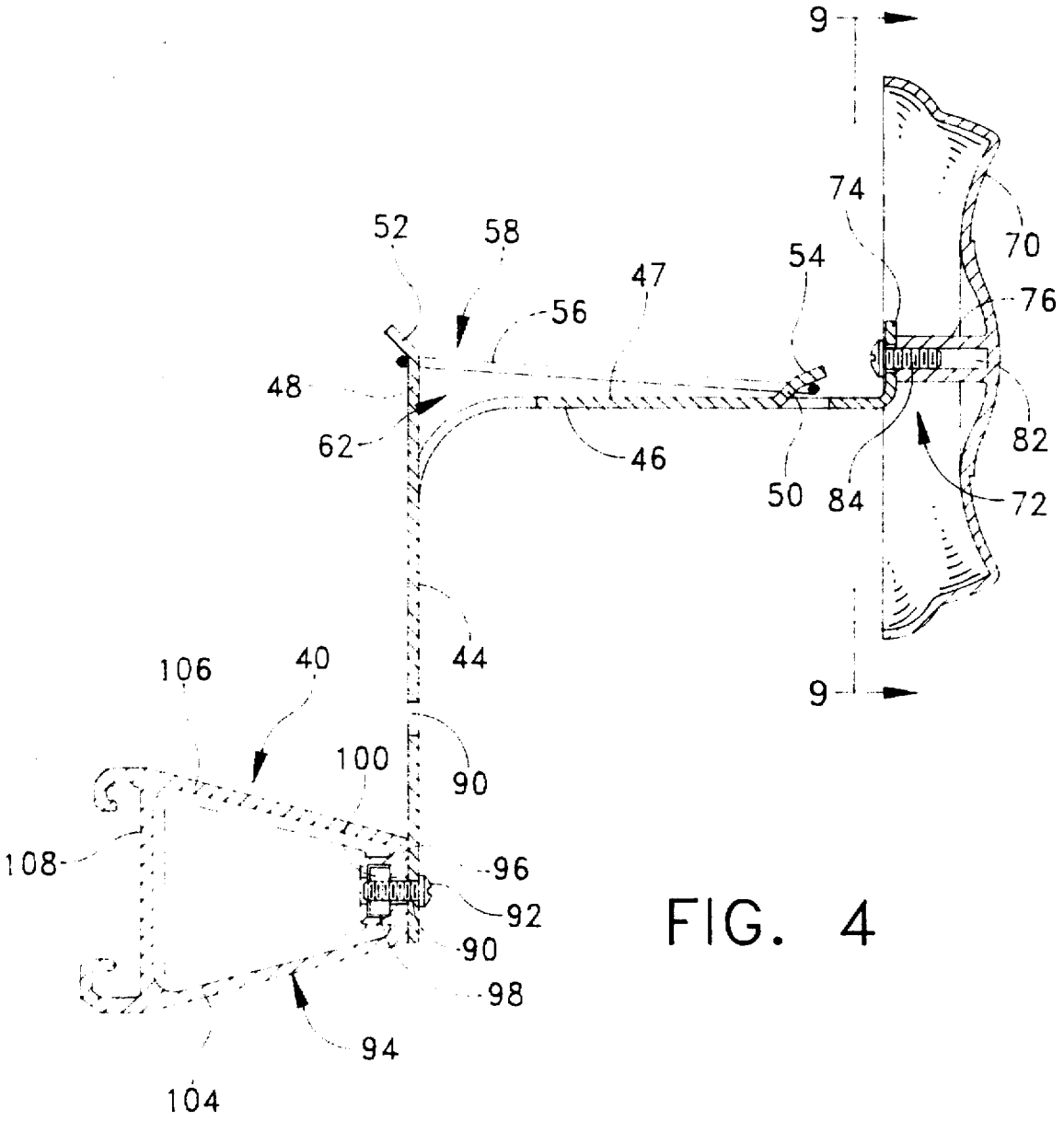
FIG. 4 is a side sectional view showing the preferred construction of the swag holder of the present invention taken along the line 4—4 of FIG. 3.
Figure 5:
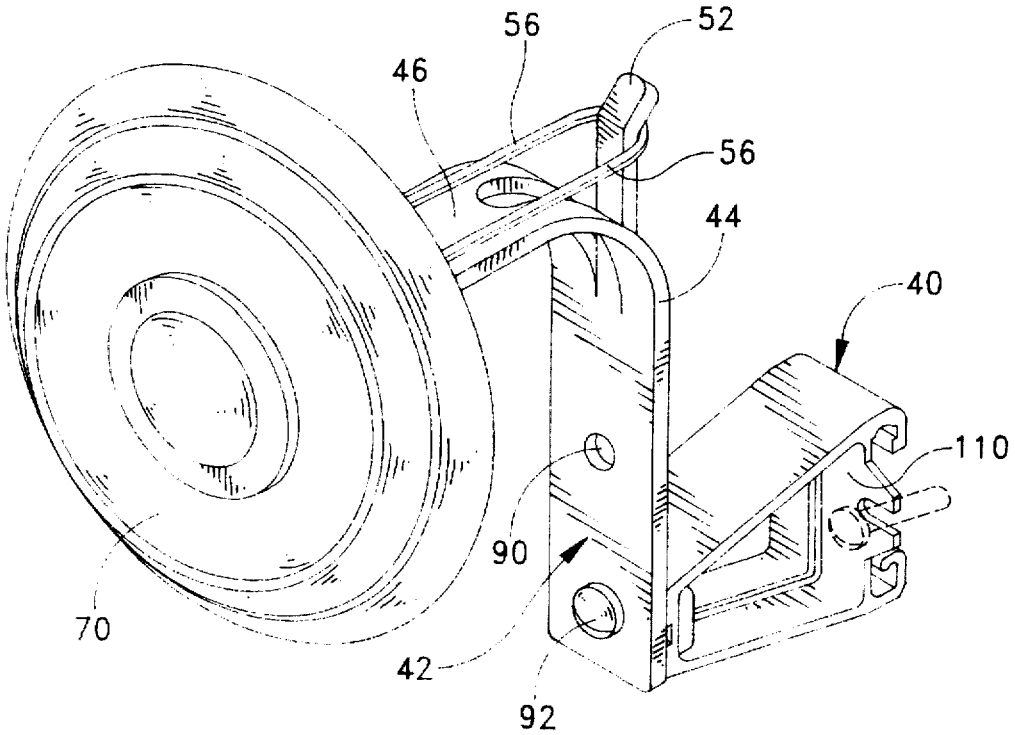
FIG. 5 is a front perspective view of the swag holder of the present invention.

Turning now to FIGS. 3 and 4 of the drawings in particular, the holding device 10 of the present invention includes a support 42 including a lower arm 44 generally adapted for vertical orientation and which includes a forward horizontal upper or support arm 46 as a continuation thereof. Generally the arms are formed as one piece of a suitable material such as cold rolled steel in a flat strip or strap form which is then suitably painted. The upper arm 46 is provided with a first or rear tab 48 which extends upwardly from the lower arm 44 and may be cut from the material of the upper arm 46 and a forward or second tab 50 forwardly displaced from the rear tab 48 and also upwardly extending from the surface of the upper arm 46. The rear tab 48 includes a rearwardly extending terminal finger portion 52. The forward or second tab 50 includes a forwardly extending finger 54 such that the tabs and the fingers cooperatively form a frame by which an elastic band or bands 56 may span the forward to rear distance between the tabs 48 and 50 in a position slightly elevated above the upper surface 47 of the lower arm 46 to provide a retaining means 58 for the fabric swag 60 passing through the vertical gap 62 formed between the upper surface 47 of the tipper arm 46 and the elastic band 56 and to be securely held in place thereby. Normally, it should be pointed out that the swag 60 is either bunched or otherwise presented in folded or pleated multi-layered fabric thicknesses since the swag is often considerably wider than the forward to rear distance of the upper arm 46. Thus, it is desirable to conceal the flattened or constricted appearance of the swag when held between the band and the upper arm; and for such purpose, a decorative disc 70 is positioned at the forward terminal end of the upper arm 46. Such terminal end 72 includes an upwardly bent generally vertical panel 74 in turn provided with a opening for the receipt of a screw or other attachment member adapted to pass through the opening into a hub rearwardly extending from the rear surface of the disc 70. The hub 76 includes a pair of wings 78 which define a notch 80 therebetween such that the edges 75 of the plate 74 co-act therewith so as to prevent rotation of the disc with respect to the support 42. In that regard, the hub 76 is provided with an opening 82 which forms a pilot for a self-tapping screw 84. In addition to the hub's decorative features above discussed, the hub can function to physically restrain the swag as well.

The lower arm 44 is provided with one or more openings 90 such that a threaded screw 92 may pass through one of such openings so as to be able to adjustably mount the retaining clip 40 of the present invention thereto. Such retaining clip includes a body 94 having a forward face 96 against which the rear surface of the lower arm 44 is adapted to engage as well as an adjacent slot 98 to receive a nut 100 therein. The slot 98 includes a blind side 102 to better retain the nut 100 therein; and in this manner, it may be apparent that by simply tightening the screw 94 that the degree to which the retainer 40 and the support 42 are held together in relative position may be adjusted, that is, when the screw 92 is fully tightened, the position of the support 42 with respect to the clip and thus with respect to the upper rail 14 is fixed; but when the screw is slightly loosened that relative position may be adjustably changed so that there is a choice of angular relationships between the support 42 vis-a-vis the window blinds as well as the window and its surrounding frame such as depicted by the dotted line representation of the left hand device shown in FIG. 2 of the drawings. It should be pointed out that this depiction is for example only, and full 360 degree rotational adjustment between the support 42 and the retaining clip 40 can be achieved, if desired.

Figure 6A:
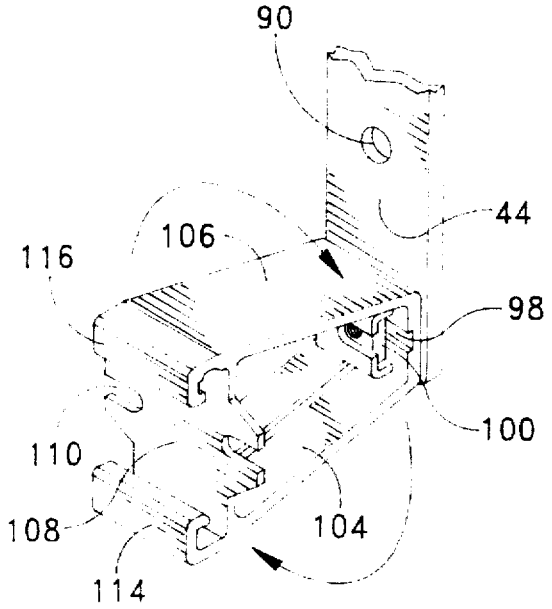
FIG. 6A is a partial rear perspective view showing in particular one of two alternate positions that the retaining clip portion may assume relative to the support portion.
Figure 6B:
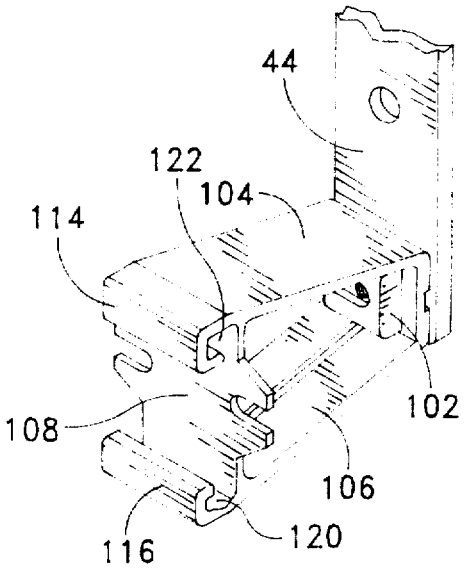
FIG. 6B is a view similar to FIG. 6A but showing the other way that the clip portion may be oriented with respect to the support portion.

The screw and nut assembly above described not only serves to position the support vis-a-vis the retaining clip 40 for the important but primarily design considerations above described but further serves to enable the clip 40 to be rotated 180 degrees to two different alternate rail engaging and clamping positions such that the device has the ability to fit on different type rail configurations such as those previously referred to and more specifically shown in FIGS. 7A and 8A. To accomplish such, the screw 92 is simply loosened to enable the clip 40 to be rotated from a first position as shown in FIG. 6A to a second or alternate position shown in FIG. 6B 180 degrees removed therefrom. The screw is then tightened to fix the clip in either of these alternate positions. The first position shown in FIG. 6A is particularly adapted to receive and be clamped on head rails of the type shown in FIGS. 7A and 7B while the second position shown in FIG. 6B is particularly adapted to receive and be clamped on head rails of the type shown in FIGS. 8A and 8B. This increases the utility of the device such that it can be used with a variety of head rail configurations used by different manufacturers of window blinds.

The retaining clip 40 further includes lower and upper support members 104 and 106 respectively as viewed in FIG. 6A which terminate at the rear ends thereof in a rear plate or wall 108 provided at either side edge thereof with inwardly extending slots 110 for the purpose of assisting in the attachment to the head rail, if desired, by means of screws (not shown) although such is not the primary purpose of the present invention and is mentioned generally to indicate an ancillary feature thereof.

Referring to the orientation of the retaining clip 40 as shown in FIG. 6A, the plate 108 includes at the rear surface thereof a first rearwardly upwardly extending generally C-shaped hook member 114 at the lower edge thereof and a second rearwardly downwardly extending generally C-shaped hook member 116 at the upper edge thereof.

The rearward extension of the second hook member 116 is somewhat less than that of hook member 114 so as to accept the lesser dimensioned lips of lower cost head rails such as the inwardly extending lip 27*a* shown in FIGS. 7A and 7B. In that regard, the hook member 116 also includes a forwardly extending terminal portion 118 which with the internal surface of the hook 116 serves to form a recess 120 having a front to tear extent dimensioned to receive the lip 27*a*. The recess may also include a domed central area 122 to enable the terminal portion of the lip 27*a* to extend thereinto as it pivots over the lip 27*a* in the connection process as illustrated in the transition between FIGS. 7A and 7B. Therein depicted, the swag holder is positioned such that the upper support member of the clip 40 and thus the appropriate hook member 116 extends downwardly through the open top of the upper rail body 25*a* such that the lip 27*a* extends into the recess 120 and then is rotated clockwise as shown by the arrow in FIG. 7A to the rail mounted position shown in FIG. 7B. In such mounted position, the forward face of the face plate 26*a* engages the rear face of the plate 108 in face to face contact so as to provide the necessary stable support for the clip 40 and thus the swag holder of the present invention. The lower hook 114 may additionally contact the base 29*a* as depicted in FIG. 7B but such is normally neither necessary or even desirable since it could limit the height of the rail constructions on which the clip 40 could be mounted which is limited by the vertical opening between the hooks 114 and 116. That is, such vertical opening is desirably dimensioned so as to accept the face plate height of the largest rail to be normally utilized with the clip which assures that rails of lesser face plate heights will accept and properly support the clip by such face to face contact.

When utilizing the clip on the stronger, thicker walled and generally lower profile height rails as represented by rail body 25*b* depicted in FIGS. 8A and 8B, the same mounting procedure as above described with reference to FIGS. 7A and 7B is carried out. The lower hook 114 being of greater front to rear extent is utilized to engage the lip 27*b* after the clip is rotated to the alternate position as described with reference to FIGS. 6A and 6B. The hook 114 includes a forwardly extending terminal portion 124 which is part defines a recess 126 into which the lip 27*b* is received in the stepwise mounting procedure shown by the transition between FIGS. 8A and 8B. The above described constructions assure vertical positioning of the clip 40 upon the rail, but as in the previous embodiment, the face to face contact between the face plate 26*b* and the plate 108 provides stable mounting surfaces for the clip while the lip to recess contact is to position the clip vis-a-vis the rail and to prevent any vertical or further rotation movement vis-a-vis the rail.

Again referring to FIG. 2 of the drawings, it should be pointed out that one or more of such devices 10 may be mounted on the head rail 14 and that the angular relationship with respect to the head rail may be modified as desired.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A swag holder adapted for direct attachment to the head rail of a window blind system mounted with respect to a window opening such that the head rail spans such window opening and wherein the head rail is of the type having a generally vertically disposed face wall terminating in an upper end, said swag holder comprising a support member having a first portion having a retaining clip fixedly connected thereto, said retaining clip having means for engaging the rail face wall so as to fixedly mount said support member to the rail, said support member further including a second portion forwardly extending from said first portion and in turn forming a generally horizontal swag supporting surface for receipt and support of a swag positioned on such supporting surface, said second portion swag supporting surface disposed forwardly of the retaining clip and the rail to which it is connected so as to support the swag forwardly of and proximate the rail and wherein said support member second portion includes means in contact with said swag for retaining the position of said swag upon said swag supporting surface and wherein said support member first and second portions being lower and upper arms respectively, said arms connected to each other wherein said lower arm is adapted for general upright positioning and said upper arm is adapted for general horizontal positioning respectively with respect to the attitude of the rail face wall in the attached position of said swag holder thereto.

2. The swag holder of claim 1, wherein said lower arm has at least one opening therethrough whereby said clip may be attached thereto, said clip being rotatably movable between at least two alternate positions so as to accommodate varying head rail configurations.

3. The swag holder of claim 2, wherein said clip includes a forward end adapted to engage said lower arm for fixed connection thereto and a rear end including a generally vertically disposed plate having opposed upper and lower edges from which first and second hook members rearwardly extend, one of said hook members adapted to extend over the upper tail edge to vertically restrain said clip on said rail while the clip plate is positioned in face to face contact with the head rail face wall so as to support said clip and restrain such from rotational movement vis-a-vis the head rail.

4. The swag holder of claim 3, wherein said retaining clip hook members being of different shape and rearward extent.

5. The swag holder of claim 2, wherein said clip is attached to said lower arm by clip attachment means comprising a clip forward end including a generally planar vertically oriented surface adapted for face to face contact with a rearwardly facing surface of said lower arm, said clip forward end including an opening adapted for alignment with said lower arm opening and a screw adapted to pass through said openings and be retained by a nut positioned adjacent the tear surface of said retaining clip forward end.

6. The swag holder of claim 5, wherein said nut is restrained by nut restraining means comprising a blind slot open at one side thereof to accept said nut in turn positioned on said rear surface of said retaining clip forward end.

7. The swag holder of claim 1, wherein said lower arm is positioned generally parallel to said rail face wall and said upper arm is positioned generally normal to said rail face wall in the attached position of said swag holder to said rail.

8. The combination assembly of a window blind system having a generally horizontally extending head rail of the type in turn having a forwardly oriented rail face wall terminating at its upper end in a rearwardly extending terminal lip and a swag holder comprising a support member including upper and lower arms wherein the upper arm is generally horizontally disposed and extends forwardly of said head rail face wall and includes an upper surface adapted to receive and support an intermediate portion of a longitudinally extending swag, a retaining clip, said lower arm including means for receiving said retaining clip, said retaining clip further including means for engaging both the rail face wall and said terminal lip so as to fixedly mount said support member to said rail, wherein said retaining clip is rotatable with respect to said lower arm between at least two alternate positions and clip attachment means for fixedly positioning said clip to said lower arm in either of said alternate positions, said clip having a generally vertically oriented plate rearwardly spaced from said clip attachment means and further including opposed upper and lower ends wherein each said end includes a rearwardly extending hook member, the hook member positioned at the plate upper end engaged with said head rail face wall lip and said clip plate disposed in face to face contact with said head rail face wall.

9. The combination assembly of claim 8, wherein said hook members are generally C-shaped.

10. The combination assembly of claim 9, wherein one of said hook members rearwardly extending a greater distance than the other.

11. The combination assembly of claim 9, wherein said hook members are of different configurations so as to accept different head rail sizes and configurations.

12. The combination assembly of a window blind system having a generally horizontally extending head rail of the type in turn having a forwardly and generally vertically oriented rail face wall terminating at its upper end in a rearwardly extending terminal lip, a longitudinally extending swag and a swag holder in turn comprising a support member including upper and lower arms wherein the upper arm is generally horizontally disposed and extends forwardly of said head rail face wall and includes an upper surface in receipt of and supporting an intermediate portion of said swag, a retaining clip, said lower arm including means for receiving said retaining clip, said retaining clip further including means for engaging both the rail face wall and said terminal lip so as to fixedly mount said support member to said rail.

13. The combination assembly set forth in claim 12, wherein said retaining clip is rotatable with respect to said lower arm between at least two alternate positions and clip attachment means for fixedly positioning said clip to said lower arm in either of said alternate positions, said clip having a generally vertically oriented plate rearwardly spaced from said clip attachment means and further including opposed upper and lower ends wherein each said end includes a rearwardly extending hook member, the hook member positioned at the plate upper end engaged with said head rail face wall lip and said clip plate disposed in face to face contact with said head rail face wall.

14. The combination assembly of claim 13, wherein said hook members are generally C-shaped.

15. The combination assembly of claim 14, wherein one of said hook members rearwardly extending a greater distance than the other.

16. The combination assembly of claim 14, wherein said hook members are of different configurations so as to accept different head rail sizes and configurations.

* * * * *